US005712232A

United States Patent [19]

Moriyama et al.

[11] Patent Number: 5,712,232

[45] Date of Patent: Jan. 27, 1998

[54] AQUEOUS LIQUID CLEANSING COMPOSITION

[75] Inventors: Masaaki Moriyama; Hisateru Tanabe; Hideyuki Hanazawa; Yasushi Kajihara, all of Tokyo, Japan

[73] Assignee: Kao Corporation, Tokyo, Japan

[21] Appl. No.: 528,095

[22] Filed: Sep. 14, 1995

[30] Foreign Application Priority Data

Sep. 20, 1994 [JP] Japan ..... 6-224440
Sep. 20, 1994 [JP] Japan ..... 6-224441

[51] Int. Cl.[6] ..... C11D 1/04; C11D 9/10; C11D 7/10

[52] U.S. Cl. ..... 510/120; 510/126; 510/123; 510/124; 510/129; 510/140; 510/137; 510/406; 510/434; 510/437; 510/480; 510/481; 510/490; 510/491; 510/501; 510/502; 510/499; 510/512

[58] Field of Search ..... 252/546, 117, 252/90; 510/126, 123, 124, 120, 129, 140, 137, 406, 434, 437, 480, 481, 490, 491, 501, 502, 499, 512

[56] References Cited

U.S. PATENT DOCUMENTS 4,184,615 1/1980 Wright ..... 222/190
5,077,041 12/1991 Yamashina et al. ..... 424/70
5,534,265 7/1996 Fowler et al. ..... 424/489
5,560,918 10/1996 Wivell et al. ..... 424/401

FOREIGN PATENT DOCUMENTS

WO91759 10/1991 WIPO .

*Primary Examiner*—Paul Lieberman
*Assistant Examiner*—Charles I. Boyer
*Attorney, Agent, or Firm*—Oblon, Spivak, McClelland, Maier & Neustadt, P.C.

[57] ABSTRACT

An aqueous liquid cleansing composition, packaged in a foamer container, said composition comprising:

(A) from 5 to 50% by weight of an anionic carboxylate surfactant; and (B) from 0.1 to 5% by weight of a salt.

The aqueous liquid cleansing composition of the present invention shows an extremely low viscosity increase at a low temperature and can be easily pushed out from the foamer container even at a low temperature thus giving uniform foam. It is particularly suitable for a skin cleanser.

10 Claims, 1 Drawing Sheet

AQUEOUS LIQUID CLEANSING COMPOSITION

FIELD OF THE INVENTION

This invention relates to an aqueous liquid cleansing composition which shows that an increase of viscosity is extremely low at a low temperature and can be easily pushed out from a foamer container even at a low temperature.

BACKGROUND OF THE INVENTION

Foam cleansing compositions usually comprise a surfactant solution of a relatively low viscosity which is packed in a roamer container and pushed out in the state of foam from the foamer container at use. Because of being excellent in convenience, usefulness, etc., these products have been employed in, for example, household cleansing compositions, hair shampoos and face cleansers. When employed as a cleanser for human, in particular, such a foam cleansing composition can make the skin clean while scarcely causing any burden on the skin. Thus it is superior to liquid, pasty or solid ones from the viewpoint of mildness. Although such a foam cleansing composition can give uniform foam at ordinary temperatures, it suffers from a problem that, at a low temperature, an increase in the viscosity of the cleansing composition packed in the container makes the foam less uniform or disturbs the pushing out.

Thus, an object of the present invention is to provide a liquid cleansing composition which suffers from no viscosity increase even at a low temperature and thus can be easily pushed out from a container and gives uniform foam at a low temperature.

SUMMARY OF THE INVENTION

Under these circumstances, the present inventors have conducted extensive studies. As a result, they have successfully found out that an aqueous liquid cleansing composition, which shows no increase of viscosity even at a low temperature and thus can be easily pushed out from a container and gives uniform foam at a low temperature, can be obtained by using an amino acid surfactant and a salt at a specific ratio, thus completing the present invention.

Accordingly, the present invention provides an aqueous liquid cleansing composition, packaged in a foamer container, said composition comprising:

(A) from 5 to 50% by weight of an anionic carboxylate surfactant; and (B) from 0.1 to 5% by weight of a salt.

Figure 1A:
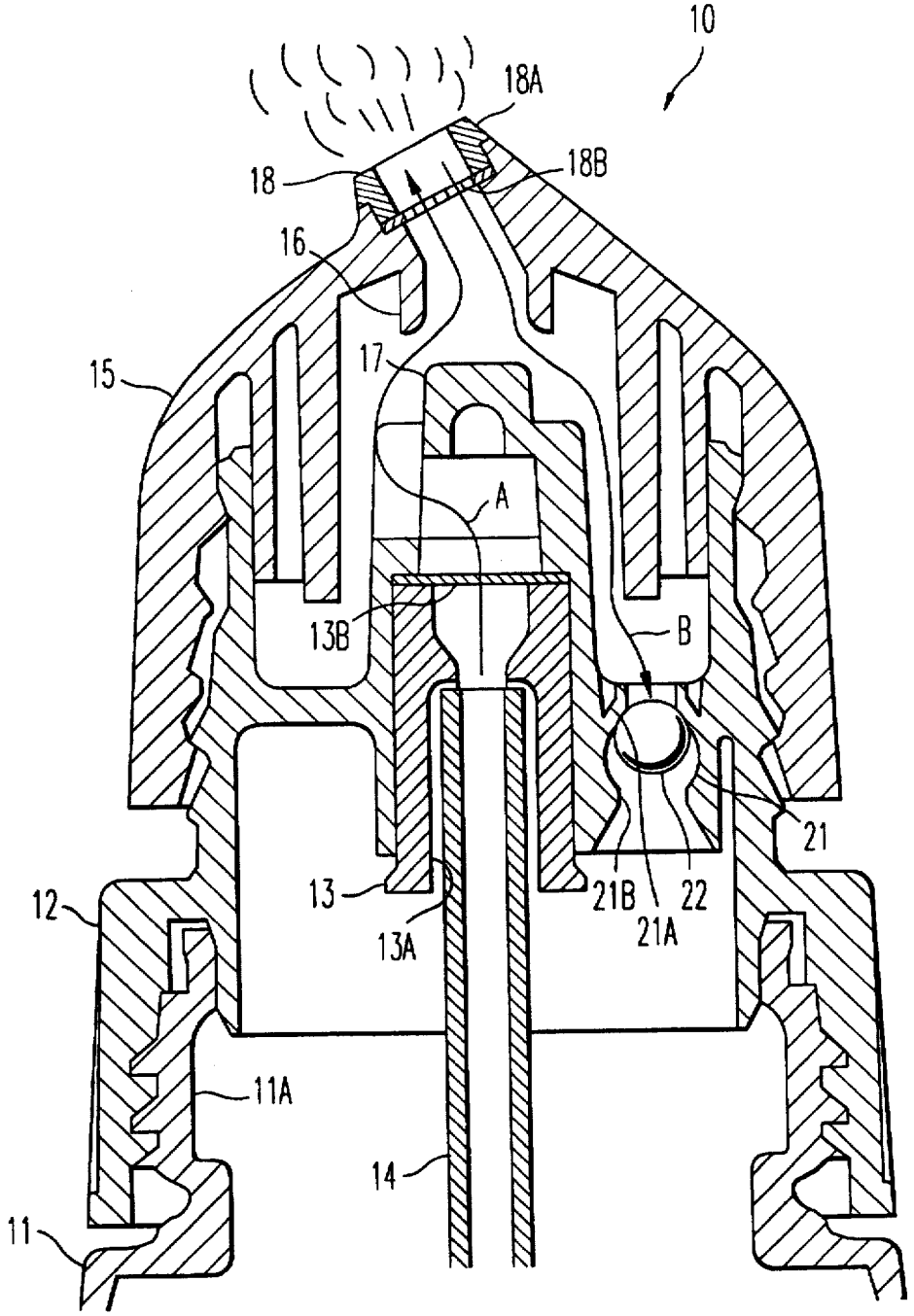
FIG. 1 is a diagram which shows an example of the foamer container to be used in the present invention, wherein 13 stands for a gas/liquid mixing unit; 13B stands for a porous membrane; 14 stands for a dip tube; 15 stands for a nozzle; 18 stands for a discharge port and 18B stands for another porous membrane.

DETAILED DESCRIPTION OF THE INVENTION (A) an anionic carboxylate surfactant of the present invention is a surfactant having a carboxylic acid and whose net charge is anionic at neutral.

The higher fatty acid salt to be used as the component (A1) in the present invention may be either a saturated or unsaturated one preferably having 8 to 22 carbon atoms, still preferably 10 to 18 carbon atoms. Preferable examples thereof include alkali metal salts (for example, sodium salts, potassium salts), ammonium salts, alkanolamine salts (for example, monethanolamine salts, diethanolamine salts, triethanolamine salts, 2-amino-2-methylpropanol salts, 2-amino-2-methylpropanediol salts), and basic amino acid salts (for example, lysine salts, arginine salts) of lauric acid, myristic acid, palmitic acid, stearic acid, isostearic acid, oleic acid, hydroxydecenoic acid, coconut oil fatty acids, reduced coconut oil fatty acids, beef tallow fatty acids, reduced beef tallow fatty acids and palm kernel oil fatty acids.

Among these higher fatty acid salts, it is particularly preferable to use triethanolamine laurate, potassium laurate, triethanolamine myristate, potassium myristate and potassium salts of coconut fatty acids.

In the case of a skin cleanser, it is particularly preferable to use a triethanolamine salt of a higher fatty acid, since the composition thus obtained has a pH value of 6.5 to 8.5 and is less irritative to the skin.

It is not always necessary to add such a higher fatty acid salt in the form of a fatty acid salt. Namely, the above-mentioned higher fatty acid and a base may be separately added to thereby form a fatty acid salt in the composition.

Either one of these higher fatty acid salts or a combination thereof may be used. The content of the higher fatty acid salt in the total composition ranges from 5 to 50 (by weight, the same will apply hereinafter), preferably from 5 to 30% and still preferably from 5 to 20%. When the content of the higher fatty acid salt is less than 5%, no sufficient detergency can be achieved. On the other hand, it is not preferable that the content thereof exceeds 50%, since the resulting composition becomes irritative to the skin.

The amino acid surfactant to be used as the component (A2) in the present invention is not particularly restricted, so long as it is a surfactant having a primary to tertiary amino group and a carboxyl group. Particular examples thereof include (A2-1) N-acylamino acid surfactants, (A2-2) amidoamino acid (imidazoline) surfactants, and (A2-3) aminodiacetic acid surfactants.

As the N-acylamino acid surfactant, it is preferable to use those represented by the following formula (1).

$$R^1-\underset{\underset{O}{\|}}{C}-\underset{\underset{R^2}{|}}{N}-\underset{\underset{R^3}{|}}{CH}-COOM^1 \qquad (1)$$

wherein $R^1$ represents a liner or branched alkyl or alkenyl group having 7 to 21 carbon atoms; $R^2$ represents a hydrogen atom or an alkyl or alkenyl group having 1 to 4 carbon atoms; $R^3$ represents $-(CH_2)_pR^4$ wherein $R^4$ represents a hydrogen atom, a hydroxyl group or $-COOM^1$ and p is a number from 0 to 2; and $M^1$ represents a hydrogen atom, an alkali metal or an alkanolamine.

It is preferable that $R^1$ in the above formula (1) is an alkyl group having 6 to 18 carbon atoms, still preferably an alkyl group having 10 to 14 carbon atoms. It is preferable that $R^2$ is a hydrogen atom or an alkyl group having 1 to 4 carbon atoms, still preferably a hydrogen atom or a methyl group. It is preferable that $R^3$ is a hydrogen atom or $-(CH_2)_pR^4$. It is preferable that $M^1$ is potassium or triethanolamine.

Preferable examples of the N-acylamino acid surfactant include N-lauroylglutamic acid, N-myristoylglutamic acid, N-lauroyl-N-methylglycine, N-lauroyl-β-alanine, N-myristoyl-β-alanine, N-lauroylaspartic acid, N-lauroylserine; alkali metal salts thereof (for example, sodium salts, potassium salts); and alkanolamine salts thereof (for example, monoethanolamine salts, diethanolamine salts, triethanolamine salts).

Although the compounds represented by the formula (1) occur in the form of L-forms, D-forms and racemic modifications, they are all usable in the present invention.

As the amidoamino acid surfactant (A2-2), it is preferable to use those represented by the following formulae (2) and (3).

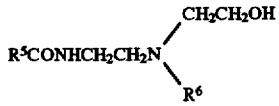

(2)

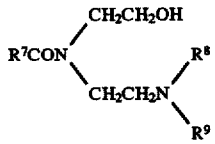

(3)

wherein $R^5$ and $R^7$ represent each a saturated or unsaturated hydrocarbon group having 7 to 19 carbon atoms; $R^6$ and $R^8$ represent each $—CH_2COOM^2$ or $—CH_2CH_2COOM^2$ wherein $M^2$ represents a hydrogen atom, an alkali metal or an alkanolamine; and $R^9$ represents a hydrogen atom, $—CH_2COOM^2$ or $—CH_2CH_2COOM^2$ wherein $M^2$ is as defined above.

It is preferable that $R^5$ and $R^7$ in the above formulae (2) and (3) are each an acyl group having 10 to 14 carbon atoms, $R^6$ and $R^8$ are each $—CH_2CH_2COOM^2$ and $R^9$ is a hydrogen atom or $—CH_2CH_2COOM^2$.

Preferable examples of the amidoamine surfactants represented by the formulae (2) and (3) include N-lauroyl-N'-carboxymethyl-N'-(2-hydoxyethyl)ethylenediamine, N-lauroyl-N'-carboxyethyl-N'-(2-hydroxyethyl) ethylenediamine, N-myristoyl-N'-carboxymethyl-N'-(2hydroxyethyl)ethylenediamine,N-lauroyl-N-(2-hydroxyethyl)-N'-carboxymethylethylenediamine and N-lauroyl-N-(2-hydroxyethyl)-N',N'-bis(carboxymethyl) ethylenediamine.

As the aminodiacetic acid surfactant (A2-3), it is preferable to use those represented by the following formula (4).

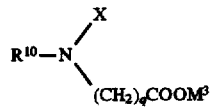

(4)

wherein $R^{10}$ represents an alkyl group, an alkenyl group, an aryl group, an aralkyl group, an alkylaryl group or an alkenylaryl group having 8 to 24 carbon atoms; X represents a hydrogen atom or $—(CH_2)_qCOOM^3$; $M^3$ represents a hydrogen atom, an alkali metal, ammonium or an alkanolamine having a hydroxyalkyl group having 2 to 3 carbon atoms; and q is a number of from 1 to 4.

It is preferable that $R^{10}$ in the above formula (4) is an alkyl group having 8 to 14 carbon atoms, X is a hydrogen atom, $M^3$ is potassium or an alkanolamine and q is 1 to 2.

Preferable examples of the aminodiacetic acid surfactant represented by the formula (4) include laurylaminopropionic acid and myristylaminopropionic acid.

From among these surfactants, particularly preferable ones are secondary amide-type N-acylamino acid salt represented by the following formula (5):

$$R^{11}CONH(CH_2)_nCOOM^4 \quad (5)$$

wherein $R^{11}CO—$ represents a linear acyl group having 10 to 16 carbon atoms; n is a number of 1 or 2; and when n is 1, then $M^4$ represents sodium, potassium or an alkanolammonium, and when n is 2, then $M^4$ represents potassium or an alkanolammonium.

In the above-mentioned secondary amide-type N-acylamino acid salt of the formula (5), it is preferable that the linear acyl group represented by $R^{11}CO—$ has 10 to 16 carbon atoms, still preferably 12 to 14, carbon atoms. Preferable examples thereof include caprinoyl, lauroyl and myristoyl groups.

Examples of the alkanolammonium represented by $M^4$ include monoethanolammonium, diethanolammonium and triethanolammonium. In particular, triethanolammonium is preferable therefor.

It is not preferable to use a surfactant of the formula (5), wherein n is 2 and $M^4$ is sodium, in a liquid skin cleanser because of its high Krafft point and poor solubility in water.

Preferable examples of the secondary amide-type N-acylamino acid salt represented by the formula (5) include N-lauroyl-β-alanine and N-myristoyl-β-alanine. Because of being less irritative to the skin, these surfactants can be suitably used in a cleansing composition.

Either one of these amino acid surfactants or a combination thereof may be used. The content of the amino acid surfactant in the total composition ranges from 5 to 50 (by weight, the same will apply hereinafter), preferably from 2 to 30% and still preferably from 5 to 20%. When the content of the amino acid surfactant is less than 1%, no sufficient detergency can be achieved. On the other hand, it is not preferable that the content thereof exceeds 50%, since there is a risk of causing jamming in the foamer container in this case.

Preferred weight ratio of (A1) and (A2) is from 10/1 to 1/10 in the aqueous liquid cleansing composition of the present invention.

As the salt to be used as the component (B) in the present invention, either an inorganic salt or an organic salt may be used. Examples of the inorganic salt include alkali metal (for example, sodium, potassium, lithium) salts, alkaline earth metal salts, ammonium salts, alkylamine salts and alkanolamine salts of inorganic acids such as hydrochloric acid, sulfuric acid, phosphorous acid, carbonic acid, phosphoric acid and boric acid. Examples of the organic salt include alkali metal salts, alkaline earth metal salts, ammonium salts, alkylamine salts and alkanolamine salts of organic acids such as acetic acid, propionic acid, oxalic acid, malonic acid, succinic acid, glutaric acid, adipic acid, citric acid, maleic acid, fumaric acid, glycolic acid, lactic acid, 2-hydroxybutyric acid, glyceric acid, hydroxymalonic acid, malic acid, tartaric acid and citric acid, salts of amino acids such as glycine, alanine, arginine, glutamic acid and serine and betaines (compounds having a quaternary amine and a carboxyl group in molecule) such as N,N,N-trimethylglycine Among these salts, it is preferable to use organic acid salts. It is still preferable to use salts of polyvalent carboxylic acids (for example, dicarboxylic acids such as oxalic acid, malonic acid, succinic acid, glutaric acid and tricarboxylic acids such as citric acid) and hydroxy acids (for example, glycolic acid, lactic acid, 2-hydroxybutyric acid). Preferable examples thereof include potassium succinate, sodium succinate, triethanolamine succinate, potassium citrate, sodium citrate, triethanolamine citrate, potassium lactate, sodium lactate, diethanolamine lactate and triethanolamine lactate.

Preferable examples of the inorganic salts include sodium phosphate and triethanolamine phosphate.

It is not always necessary to add such a salt of the component (B) in the form of a salt. Namely, the above-mentioned acid and a base may be separately added to thereby form a salt in the composition.

Either one of these salts or a combination thereof may be used. The content of the salt in the total composition ranges from 0.1 to 5%, preferably from 0.2 to 5 and still preferably from 1 to 4%. When the content of the salt is less than 0.1%, a viscosity at a low temperature cannot be prevented. On the other hand, it is not preferable that the content thereof exceeds 5%, since the viscosity of the system becomes excessively high in this case.

Although it is not always necessary that the base of the component (A) is the same as the base of the component (B), it is preferable to use the same base therefor from the viewpoint of safety.

A cleansing composition is prepared by dissolving the above-mentioned components (A) and (B) in an aqueous medium. Examples of the aqueous medium to be used herein include water or a mixture of water with glycerol, ethanol, etc. The content of the aqueous medium in the total composition ranges from 50 to 94.9%, preferably 60 to 85%.

In addition to the above-mentioned higher fatty acid salt or amino acid surfactant, the cleansing composition may further contain other anionic, amphoteric or nonionic surfactants commonly employed in cleansing compositions, so long as the effects of the present invention are not deteriorated thereby. Particular examples of these surfactants are as follows.

(1) Linear or branched alkylbenzenesulfonic acid salts having an alkyl group with an average carbon atom number of 10 to 16.

(2) Alkyl or alkenyl ether sulfuric acid salts having a linear or branched alkyl or alkenyl group with an average carbon atom number of 10 to 20 to which 0.5 to 8 mol (on average) of ethylene oxide, propylene oxide, butylene oxide, ethylene oxide/propylene oxide (at a ratio of 0.1/9.9 to 9.9/0.1), or ethylene oxide/butylene oxide (at a ratio of 0.1/9.9 to 9.9/0.1) are added per molecule.

(3) Alkyl or alkenylsulfuric acid salts having an alkyl or alkenyl group with an average carbon atom number of 10 to 20.

(4) Olefinesulfonic acid salts with an average carbon atom number of 10 to 20 per molecule.

(5) Alkanesulfonic acid salts with an average carbon atom number of 10 to 20 per molecule.

(6) α-sulfo fatty acid salts or esters having an alkyl or alkenyl group with an average carbon atom number of 10 to 20.

Examples of the counter ion of the anionic residue in these surfactants include alkali metal (for example, sodium, potassium) ions, alkaline earth metal (for example, calcium, magnesium) ions, ammonium ion and alkanolamines having 1 to 3 alkanol groups with 2 or 3 carbon atoms (for example, monoethanolamine, diethanolamine, triethanolamine, triisopropanolamine). Examples of the counter ion of the cationic residue include halogen (for example, chlorine, bromine, iodine) ions, methosulfate and saccharinate ions.

(7) α-Addition type secondary amide or tertiary amide imidazoline amphoteric surfactants having an alkyl, alkenyl or acyl group with 8 to 24 carbon atoms.

(8) Carbobetaine-, amidobetaine-, sulfobetaine-, hydroxysulfobetaine- or amidosulfobetaine amphoteric surfactants having an alkyl, alkenyl or acyl group with 8 to 24 carbon atoms.

(9) Fatty acid amide derivatives having an alkyl group with 8 to 20 carbon atoms represented by the following formula.

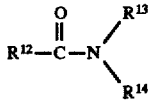

wherein $R^{12}$ represents an alkyl group having 8 to 20 carbon atoms; and $R^{13}$ and $R^{14}$ may be either the same or different and each represents a hydrogen atom, an alkyl group having 1 to 3 carbon atoms, a hydroxyalkyl group having 1 to 3 carbon atoms or $—(C_2H_4O)_mH$ wherein m is a number of 2 to 4.

(10) Alkylsaccharide surfactants represented by the following formula.

$$R^{15}—0—(R^{16}O)_a—G_b$$

wherein $R^{15}$ represents a linear or branched alkyl, alkenyl or alkylphenyl group having 8 to 18 carbon atoms; $R^{16}$ represents an alkylene group having 2 to 4 carbon atoms; a is a number of 0 to 10; G represents a reducing sugar having 5 to 6 carbon atoms; and b represents a number of 1 to 10.

Among these surfactants, particularly preferable ones include alkyl ether sulfuric acid salts, fatty acid salts, alkylsaccharide surfactants, fatty acid amide derivatives and betaine amphoteric surfactants. Moreover, it is preferable to add higher fatty acid salts thereto to thereby give a refreshing feel after washing and good foaming.

In addition to the above-mentioned surfactants, the cleansing composition may contain other components commonly employed in cleansing composition compositions, for example, oily matters, humectants, polymeric compounds, preservatives, chelating agents, medical components, coloring matters, perfumes, antioxidants and pH regulators, so long as the effects of the present invention are not deteriorated thereby.

When measured at 5° C. with a Brookfield viscometer (manufactured by Tokyo Keiki), the viscosity of the cleansing composition thus obtained is preferably 30 cps or below, still preferably 1 to 15 cps, though it varies depending on the container employed. The viscosity may be regulated by selecting appropriate components. When the viscosity of the cleansing composition at 5° C. exceeds 30 cps, uniform foam cannot be obtained and it becomes difficult to push out the cleansing composition from the container.

The cleansing composition thus obtained is packed in a foamer container having porous membranes. Examples of the porous membranes include sponge, sintered materials and nets. A thin net is preferable therefor among these porous membranes. This is because, when the cleansing composition adhering and remaining on the membrane is dried and solidified and thus causes jamming, the solidified matter can be easily dissolved in the foam flow subsequently discharged from the container, thus solving the problem of jamming.

To achieve good foaming, it is preferable to use nets of 50 to 500 mesh, still preferably 200 to 400 mesh. Examples of the materials of these nets include nylon and polyester.

It is preferable that the container is provided with two or more membranes. From the viewpoints of cost, foaming stability, etc., it is still preferable that the container has two membranes.

The foamer container may be an arbitrary one, so long as a definite amount of the cleansing composition can be mixed with a definite amount of air thereby and discharged therefrom in the state of foam. Examples thereof include squeeze foamers composed of a soft container to be pushed with fingers, for example, those described in JP-A-U-58-174272, JP-A-U-62-42787 and JP-B-52-16567, and pump foamers provided with a pumping unit with a cap which is to be pushed with fingers, for example, those described in JP-A-U-3-7963 and JP-A-U-62-103458 (the term "JP-A-U" as used herein means an "unexamined published Japanese utility model application", while the term "JP-B" as used herein means an "examined Japanese patent publication").

Figure 1B:
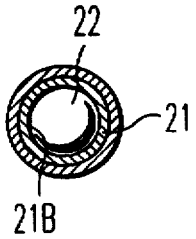

FIG. 1 shows a preferable example of the foamer container to be used in the present invention.

In the foamer container 10 of FIG. 1, the squeezable body 11 of the container has an opening 11A provided with a screw cap 12. A gas/liquid mixing unit 13 is located at the center of the inside of the cap 12. This gas/liquid mixing unit 13 is provided with a tube connector 13A and a porous membrane 13B.

Into the foamer container 10, a dip tube 14 is fitted via a definite space from the tube connector 13A. Thus the dip tube 14 is supported by the cap 12 and inserted into the container body 11 while being linked to the gas/liquid mixing unit 13.

The foamer container 10 has a switch nozzle 15 screwed on the discharge side (upper part in the figure) of the gas/liquid mixing unit 13 of the cap 12. This nozzle 15 is switched from on to off and vice versa by rotating at an angle of 90° against the cap 12. When the nozzle 15 is set at "off", a seal ring 16 circularly projecting from the nozzle 15 closely adheres to a plug 17 which is at the upper part of the gas/liquid mixing unit 13. When the nozzle 15 is set at "on", the seal ring 16 is separated from the plug 17 so as to form a discharge channel. A discharge port 18 of the nozzle 15 is provided with a porous membrane fixing member 18A and a porous membrane 18B at the tip. The porous membrane 18B is fixed by the porous membrane fixing member 18A.

The foamer container 10 has a ball valve 22 in the air-return channel 21 of the cap 12. At the discharge of foam, this ball valve 22 closely adheres to a sealing unit 21A located at the upper part of the air-return channel and thus elevate the pressure in the container body 11 via squeezing. After the completion of the discharge of the foam, the ball valve 22 is held by a project 21B located in the lower part of the air-return channel 21. After relieving the squeezing, air is introduced into the container body 11 due to the negative pressure in the container caused by the restoring force of the container body 11.

Foam is discharged from the roamer container 10 as follows.

(1) By rotating the nozzle 15, the seal ring 16 of the nozzle 15 is separated from the plug 17 of the cap 12 to thereby form a foam discharge channel shown by an arrow A in FIG. 1.

(2) When the container body 11 is manually squeezed, the air (or liquid) directly introduced into the gas/liquid mixing unit 13 of the cap 12 is mixed with the liquid (or air) introduced into the gas/liquid mixing unit 13 via the dip tube 14. The resulting foam passing through the porous membrane 13B is then transferred along the above-mentioned foam discharge channel A and discharged from the discharge port 18 via the porous membrane 18B provided at the tip of the discharge port 18 of the nozzle 15. Then the ball valve 22 closely adheres to the sealing unit 21A of the air-return channel 21 to thereby elevate the pressure in the container body 11.

(3) After the completion of the discharge of the foam, the ball valve 22 is held by the project 21B located in the air-return channel 21. After relieving the squeezing, the external air is introduced into the container body 11 along the air-return channel shown by an arrow B in FIG. 1 due to the negative pressure in the container caused by the restoring force of the container body 11. Although the external air tries to advance in the foam discharge channel A in the opposite direction too, it is prevented by the foam remaining on the porous membrane 13B. Thus the air advances along the air-return channel B as described above. When the foam remaining on the porous membrane 18B allows only slow introduction of the air, another foamer container, wherein an air-return channel 21 and a ball valve 22 are located at such positions as to directly link to the outside of the cap 12, may be used as a substitute for the above-mentioned one.

In the aqueous liquid cleansing composition of the present invention, the cleansing composition is converted into foam after passing trough a membrane. The density of the foam thus formed preferably ranges from 0.03 to 0.25 g/ml, still preferably from 0.06 to 0.15 g/ml. A foam density falling within this range is preferable particularly in the case of a skin cleanser, since a high detergency and a good massage can be achieved thereby. The foam density can be determined by discharging the foam from the foamer into a 100 ml graduated cylinder and weighing.

The aqueous liquid cleansing composition of the present invention can be appropriately used as skin cleansers such as face cleansing foams, cleansing foams, shaving foams, body foams and hair foams.

The aqueous liquid cleansing composition of the present invention shows an extremely low viscosity increase at a low temperature and can be easily pushed out from a foamer container at a low temperature, thus giving uniform foam.

To further illustrate the present invention in greater detail, and not by way of limitation, the following Examples will be given.

EXAMPLE 1

Cleansing compositions of the compositions as specified in Table 1 were produced by a conventional method.

Each cleansing composition thus obtained was packed in a foamer container of FIG. 1 having two 200-mesh polyester screens 13B and 18B (manufactured by NBC Kogyo). Then the push-out performance at 5° C. was evaluated in the following manner. Namely, the cleansing composition packed in the container was stored at 5° C. for 24 hours and then pushed out from the container at 5° C. A sample which could be easily pushed out was evaluated as O, while one which could be hardly pushed out was evaluated as x. Table 1 summarizes the results.

TABLE 1

| | Invention product | | | Comparative product | | | |
|---|---|---|---|---|---|---|---|
| Component (%) | 1 | 2 | 3 | 1 | 2 | 3 | 4 |
| lauric acid | 16 | — | — | 16 | 16 | — | — |
| N-lauroyl-β-alanine | — | 15 | 15 | — | — | 15 | 15 |
| triethanolamine citrate | 2 | 4 | 2 | 6 | — | 16 | — |
| triethanolamine (89%) | 12.5 | 12 | 12 | 12.5 | 12.5 | 12 | 12 |
| water | the balance | ← | ← | ← | ← | ← | ← |
| total | 100 | 100 | 100 | 100 | 100 | 100 | 100 |
| push-out performance (5° C.) | ○ | ○ | ○ | x | x | x | x |

The results given in Table 1 indicate that each product of the present invention showed no viscosity increase at 5° C., could be easily pushed out and gave uniform form.

EXAMPLE 2

Cleansing compositions of the compositions as specified in Tables 2, 3 and 4 were produced by a conventional method. Similar to Example 1, each cleansing composition thus obtained was packed in a foamer container and the push-out performance was evaluated at 5° C. Tables 2, 3 and 4 summarize the results.

TABLE 2

| | Invention product | | | | Comparative product |
|---|---|---|---|---|---|
| Component (%) | 4 | 5 | 6 | 7 | 5 |
| lauric acid | 2 | 2 | 2 | 2 | 2 |
| myristic acid | 2 | 2 | 2 | 2 | 2 |
| palmitic acid | 1 | 1 | 1 | 1 | 1 |
| oleic acid | 1 | 1 | 1 | 1 | 1 |
| ammonium phosphate | 5 | — | — | — | — |
| triethanolamine citrate | — | 5 | — | — | — |
| sodium succinate | — | — | 5 | — | — |
| diethanolamine lactate | — | — | — | 5 | — |
| monolaurylphosphoric acid | 5 | 5 | 5 | 5 | 5 |
| triethanolamine | 12 | 10 | 10 | 10 | 10 |
| lauric acid ethylene oxide (3 mol) adduct | 2 | 2 | 2 | 2 | 2 |
| glycerol | 15 | 15 | 15 | 15 | 15 |
| glyceride caprylate | 1 | 1 | 1 | 1 | 1 |
| pentaglyceride stearate | 0.5 | 0.5 | 0.5 | 0.5 | 0.5 |
| p-oxybenzoates | 0.5 | 0.5 | 0.5 | 0.5 | 0.5 |
| perfume | 0.3 | 0.3 | 0.3 | 0.3 | 0.3 |
| water | the balance | ← | ← | ← | ← |
| push-out performance (5° C.) | ○ | ○ | ○ | ○ | x |

TABLE 3

| | Invention product | | | | Comparative product |
|---|---|---|---|---|---|
| Component (%) | 8 | 9 | 10 | 11 | 6 |
| lauric acid | 3 | 3 | 3 | 3 | 3 |
| myristic acid | 1 | 1 | 1 | 1 | 1 |
| palmitic acid | 1 | 1 | 1 | 1 | 1 |
| oleic acid | 1 | 1 | 1 | 1 | 1 |
| sodium phosphate | 3 | — | — | — | — |
| potassium citrate | — | 3 | — | — | — |
| potassium succinate | — | — | 3 | — | — |
| sodium lactate | — | — | — | 3 | — |
| N-laurylbetaine | 1 | 1 | 1 | 1 | 1 |
| potassium hydroxide | 2 | 2 | 2 | 2 | 2 |

TABLE 3-continued

| | Invention product | | | | Comparative product |
|---|---|---|---|---|---|
| Component (%) | 8 | 9 | 10 | 11 | 6 |
| lauric acid ethylene oxide (3 mol) adduct | 2 | 2 | 2 | 2 | 2 |
| glycerol | 20 | 20 | 20 | 20 | 20 |
| glyceride caprylate | 1 | 1 | 1 | 1 | 1 |
| pentaglyceride stearate | 0.5 | 0.5 | 0.5 | 0.5 | 0.5 |
| p-oxybenzoates | 0.5 | 0.5 | 0.5 | 0.5 | 0.5 |
| perfume | 0.3 | 0.3 | 0.3 | 0.3 | 0.3 |
| water | the balance | ← | ← | ← | ← |
| push-out performance (5° C.) | ○ | ○ | ○ | ○ | x |

TABLE 4

| | Invention product | | | | Comparative product |
|---|---|---|---|---|---|
| Component (%) | 12 | 13 | 14 | 15 | 7 |
| N-lauroyl-β-alanine | 5 | 5 | 5 | 5 | 5 |
| lauric acid | 2 | 2 | 2 | 2 | 2 |
| myristic acid | 2 | 2 | 2 | 2 | 2 |
| palmitic acid | 1 | 1 | 1 | 1 | 1 |
| oleic acid | 1 | 1 | 1 | 1 | 1 |
| ammonium phosphate | 5 | — | — | — | — |
| triethanolamine citrate | — | 5 | — | — | — |
| triethanolamine succinate | — | — | 5 | — | — |
| diethanolamine lactate | — | — | — | 5 | — |
| triethanolamine | 10 | 10 | 10 | 10 | 10 |
| lauric acid ethylene oxide (3 mol) adduct | 2 | 2 | 2 | 2 | 2 |
| glycerol | 15 | 15 | 15 | 15 | 15 |
| glyceride caprylate | 1 | 1 | 1 | 1 | 1 |
| pentaglyceride stearate | 0.5 | 0.5 | 0.5 | 0.5 | 0.5 |
| p-oxybenzoates | 0.5 | 0.5 | 0.5 | 0.5 | 0.5 |
| perfume | 0.3 | 0.3 | 0.3 | 0.3 | 0.3 |
| water | the balance | ← | ← | ← | ← |
| push-out performance (5° C.) | ○ | ○ | ○ | ○ | x |

The results given in Tables 2 to 4 indicate that each product of the present invention showed no viscosity increase at 5° C., could be easily pushed out and gave uniform foam.

EXAMPLE 3

| (Component) | (%) |
|---|---|
| N-lauroyl-β-alanine | 5.0 |
| lauric acid | 4.0 |
| potassium hydroxide | 2.5 |
| potassium succinate | 2.0 |
| glycerol | 5.0 |
| polyoxyethylene (5) monolaurate | 0.5 |
| cocoylamido propyl betaine | 0.3 |
| isopropylmethyl phenol | 0.2 |
| perfume | 0.2 |
| water | the balance |

A cleansing composition of the above composition was produced and packed in the same foamer container as the one used in Example 1. As a result, the foam thus obtained was excellent in sturdy texture and massage characteristics. Moreover, the composition showed no viscosity increase at a low temperature and could be pushed out from the container at 5° C.

What is claimed is:

1. An aqueous liquid cleansing composition, consisting essentially of:

(A) from 5 to 50% by weight of a carboxylate surfactant; and (B) from 0.1 to 5% by weight of an inorganic acid salt or organic acid salt, wherein:

when said salt is an inorganic acid salt it is selected from the group consisting of an alkali metal, alkaline earth metal, ammonium, alkylamine, and alkanolamine salt of an inorganic acid, and when said salt is an organic acid salt it is selected from the group consisting of an alkali metal, alkaline earth metal, ammonium, alkylamine, and alkanolamine salt of an organic acid selected from the group consisting of acetic acid, propionic acid, oxalic acid, malonic acid, succinic acid, glutaric acid, adipic acid, citric acid, maleic acid, fumaric acid, glycolic acid, lactic acid, 2-hydroxybutyric acid, glyceric acid, hydroxymalonic acid, malic acid, tartaric acid, and citric acid, and wherein said composition has a viscosity of 30 cps or less at 5° C. and is packaged in a squeeze or pump foamer container wherein said carboxylate surfactant is selected from the group consisting of N-lauroyl-β-alanine, N-myristoyl-β-alanine and a compound represented by the following formula (1):

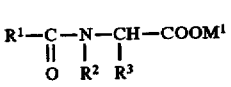

(1)

wherein $R^1$ represents a linear or branched alkyl or alkenyl group having 7 to 21 carbon atoms; $R^2$ represents a hydrogen atom or an alkyl or alkenyl group having 1 to 4 carbon atoms; $R^3$ represents $—(CH_2)_pR^4$ wherein $R^4$ represents a hydrogen atom, a hydroxyl group or $—COOM^1$; $M^1$ represents a hydrogen atom, an alkali metal or an alkanolamine; and p is a number from 0 to 2.

2. The aqueous liquid cleansing composition as claimed in claim 1, wherein said salt (B) is an organic acid salt.

3. The aqueous liquid cleansing composition as claimed in claim 1, further consisting essentially of (A1) a higher fatty acid salt in the weight ratio of A1 to carboxylate surfactant of from 10/1 to 1/10.

4. The aqueous liquid cleansing composition as claimed in claim 1, further consisting essentially of a surfactant (A2) which is a member selected from the group consisting of:

(A2-1) a N-amyl amino acid surfactant (A2-2) an amidoamino acid surfactant (A2-3) an aminodiacetic acid surfactant.

5. The aqueous cleansing composition as claimed in claim 4, wherein said amidoamino acid surfactant represented by formula (2) or (3):

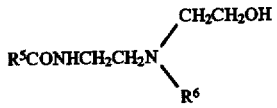

(2)

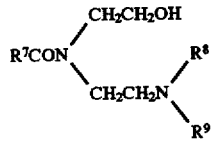

(3)

wherein $R^5$ and $R^7$ represent each a saturated or unsaturated hydrocarbon group having 7 to 19 carbon atoms; $R^6$ and $R^8$ represent each $—CH_2COOM^2$ or $—CH_2CH_2COOM^2$ wherein $M^2$ represents a hydrogen atom, an alkali metal or an alkanolamine; and $R^9$represents a hydrogen atom, $—CH_2COOM^2$ or $—CH_2CH_2COOM^2$ wherein $M^2$represents a hydrogen atom, an alkali metal or an alkanolamine.

6. The aqueous cleansing composition as claimed in claim 4, wherein said carboxylate surfactant is an aminodiacetic acid surfactant represented by the following formula (4):

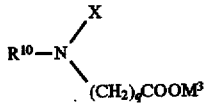

(4)

wherein $R^{10}$ represents an alkyl group, an alkenyl group, an aryl group, an aralkyl group, an alkylaryl group or an alkenylaryl group having 8 to 24 carbon atoms; X represents a hydrogen atom or $—(CH_2)_qCOOM^3$; $M^3$ represents a hydrogen atom, an alkali metal, ammonium or an alkanolamine having a hydroxyalkyl group having 2 to 3 carbon atoms; and q is a number of from 1 to 4.

7. The aqueous liquid cleansing composition as claimed in claim 1, wherein said foamer container has two or more porous membranes.

8. The aqueous cleansing composition as claimed in claim 1, wherein said salt (B) is selected from the group consisting of potassium succinate, sodium succinate, triethanolamine succinate, potassium citrate, sodium citrate, triethanolamine citrate, potassium lactate, sodium lactate, diethanolamine lactate, triethanolamine lactate, sodium phosphate, and triethanolamine phosphate.

9. The aqueous cleansing composition as claimed in claim 1, wherein said composition when dispensed from said foamer is dispensed as a foam.

10. The aqueous cleansing composition as claimed in claim 1, wherein said carboxylate surfactant is a N-acylamino acid surfactant selected from the group consisting of N-lauroylglutamic acid, N-myristoylglutamic acid, N-lauroyl-N-methylglycine, N-lauroyl-β-alanine, N-myristoyl-β-alanine, N-lauroylaspartic acid, N-lauroylserine, and alkali metal or alkanolamine salts thereof.

* * * * *